US005699977A

United States Patent [19]

Watanabe

[11] Patent Number: 5,699,977

[45] Date of Patent: Dec. 23, 1997

[54] COIL WINDING DEVICE AND COIL WINDING METHOD

[75] Inventor: Yasuhiro Watanabe, Tokyo, Japan

[73] Assignee: Sony Corporation, Tokyo, Japan

[21] Appl. No.: 597,158

[22] Filed: Feb. 6, 1996

[30] Foreign Application Priority Data

Feb. 23, 1995 [JP] Japan ..... 07-058249

[51] Int. Cl.[6] ..... H01J 9/236; H01J 29/76

[52] U.S. Cl. ..... 242/439; 29/605

[58] Field of Search ..... 29/605; 242/439, 242/440.1, 441

[56] References Cited

U.S. PATENT DOCUMENTS

| | | | |
|---|---|---|---|
| 3,672,026 | 6/1972 | Cutler et al. | 242/440.1 |
| 4,217,937 | 8/1980 | Ache et al. . | |
| 4,639,708 | 1/1987 | Weatherly | 29/605 |
| 5,191,307 | 3/1993 | Hashimoto et al. . | |
| 5,409,558 | 4/1995 | Takahasi et al. | 29/605 |
| 5,419,503 | 5/1995 | Watanabe et al. | 242/439 |
| 5,484,113 | 1/1996 | Watanabe | 29/605 |
| 5,547,532 | 8/1996 | Wernersbach, Jr. et al. | 29/605 |

*Primary Examiner*—Katherine Matecki
*Attorney, Agent, or Firm*—Ronald P. Kananen

[57] ABSTRACT

In order to wind a coil on a bobbin, the bobbin is supported on a rotating unit. Wire, which is supplied to a nozzle, is first clamped by a clamp which is synchronously rotatable with the bobbin. The nozzle is then moved along two mutually perpendicular axes so as to, in combination with the rotational movement of the bobbin, permit a coil or coils to be wound on the bobbin. After the wire is wound onto the bobbin, the wire is clamped and cut by a clamping and cutting arrangement which is stationary with respect to the bobbin rotation.

7 Claims, 4 Drawing Sheets

COIL WINDING DEVICE AND COIL WINDING METHOD

BACKGROUND OF THE INVENTION

1. Field of the Invention

This invention relates to a coil winding device and a winding method for forming a VLF coil and the like to be fixed to a front surface of a deflecting yoke of a television set or the like.

2. Description of Related Art

A VLF coil for use in cancelling a ultra-low frequency generated by a deflecting yoke is fixed to the front surface of the deflecting yoke of a television set.

In connection with this VLF coil it has been previously proposed to form the two coils of the device seperately using a winding machine and then manually insert the coils onto a bobbin.

However, this method has suffered from the drawback of low productivity and poor quality stability due to the fact that the coils were manually assembled.

In addition, the related art winding machine suffers from the drawback that the length of the coil end was fixed and could not be varied, resulting in a wasteful wire surplus when the end of the wire was wound at the terminal of the base plate arranged on the bobbin.

Further, the related art encountered the problem of requiring a large number of assembling and soldering steps as well as a high cost due to the fact that the two coils were inserted into the bobbin and soldered to form a single coil arrangement.

SUMMARY OF THE INVENTION

The present invention has been completed in view of the aforesaid problems and it is an object of the present invention to provide a coil winding device and a coil winding method capable of improved productivity, concurrently stable quality, reduced cost and thus capable of producing an inexpensive coil.

Further objects of the present invention will become apparent as the following description of the preferred embodiment is made.

This object is accomplished in the device of the present invention by arranging a configuration comprised of a bobbin rotating unit for holding a bobbin on which a wire is wound while it is being rotated; a nozzle for sequentially feeding out wire; wire clamp means for clamping a starting end of winding of the wire fed out of the nozzle which is rotated with the bobbin rotating unit; cutting means for clamping and cutting a finishing end of the wound wire; and NC (numerical control) control means for controlling selective motion of the nozzle in a vertical direction substantially at a right angle to a horizontal direction in parallel with an axis of the bobbin, controlling a rotation of the bobbin rotating unit, controlling a clamp of the wire with the wire clamp means and controlling the clamp and cutting of the wire with the cutting means.

In addition, in the case that the present invention is to be performed, the cutting means can optionally adjust a length of the finished end of the wire of winding operation which is fed out of the bobbin, or be provided with grooves for guiding the wire at an outer circumference of the bobbin so as to wind the wire in the grooves and thus form a coil which can be utilized as a VLF coil.

In addition, this object of the present invention achieved by using a NC (numerical control) control means which continuously controls a) the rotation of a bobbin rotating unit that holds the bobbin so as to facilitate the winding of wire onto bobbin, b) a sequential feeding-out of the wire through the nozzle, c) the clamping operation of the wire clamping means for clamping a winding starting end of the wire fed out of the nozzle and integrally rotating it with the bobbin rotating unit, and d) clamping and cutting operations of the cutting means for clamping the finished end of the winding of the wire and cut it and thus automatically wind the wire on the bobbin.

According to the present invention, it is possible to perform an automatic winding of the wire and to form simply a predetermined coil.

In addition, in the case that the cutting means can optimally adjust the length of the finished end of winding of the wire to be fed out of the bobbin, a coil having always a proper length and useless volume of wire end can be attained.

In addition, in the case that an outer circumference of the bobbin is provided with grooves for guiding the wire and the wire is wound in the grooves, a precise setting of the coil on the bobbin can be performed easily and accurately.

DESCRIPTION OF THE PREFERRED EMBODIMENT

Figure 1:
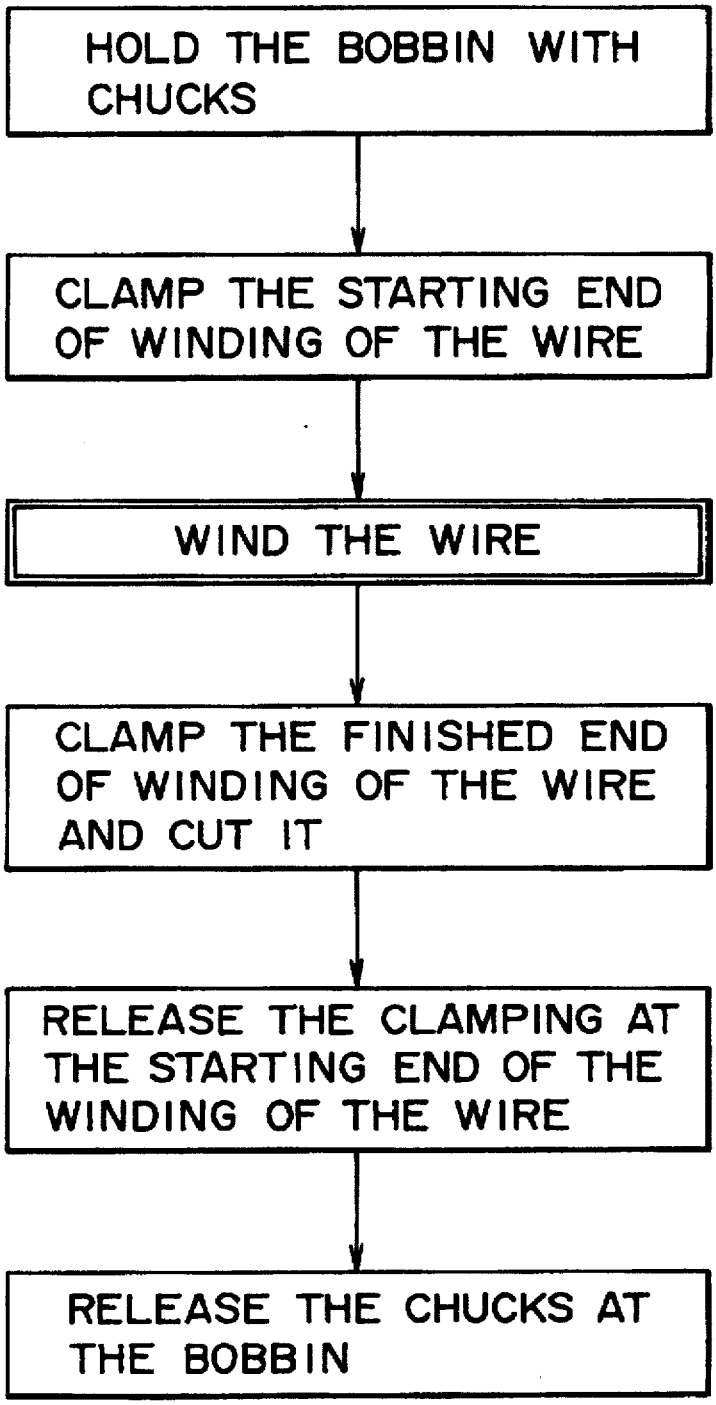
FIG. 1 is a flow chart showing one example of a procedure possible with the present invention.

Referring now to the drawings, preferred embodiment of the present invention will be described in detail.

Figure 2:
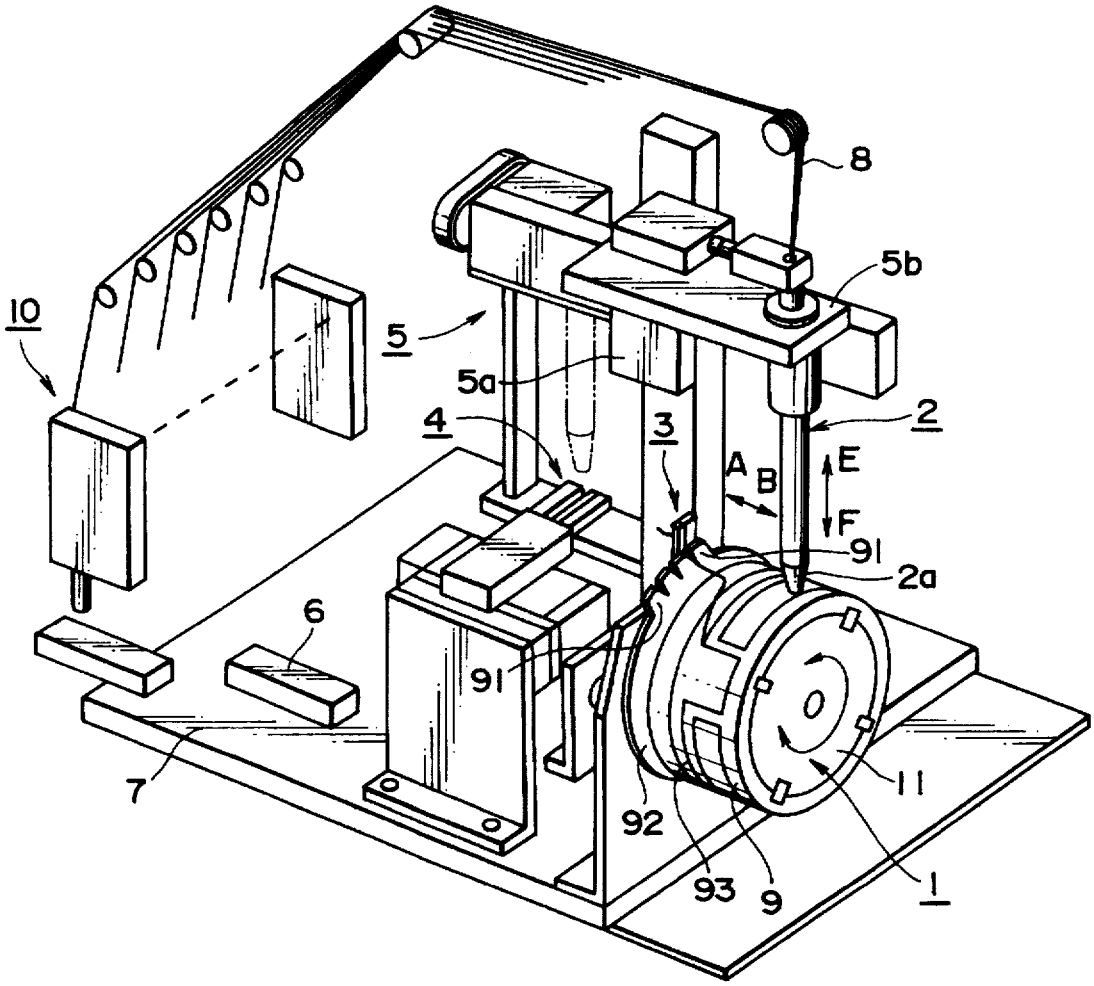
FIG. 2 a schematic view for showing an arrangement of a device according to the present invention.

FIG. 2 is a schematic view showing a configuration of a coil winding device according to a preferred embodiment of the present invention. The coil winding device shown in FIG. 2 is generally comprised of a bobbin rotating unit 1; a wire nozzle part 2; a wire clamp part 3; a clamp and cutting part 4; a wire nozzle part moving mechanism 5; an NC (numerical control) control part 6; and a base 7 having these components arranged thereon and the like.

More particularly, a wire supplying part 10 having wires 8 wound and stocked therein, is installed on the base 7. The wire 8 from the wire supplying part 10 is supplied to the wire nozzle part 2 through a plurality of guide rollers and the like. The wires are fed out in sequence from the extremity end of the nozzle 2*a*.

The bobbin rotating unit 1 can be rotated in both normal and reverse directions by a motor (not shown). One end of the bobbin rotating unit has a chuck 11 by way of which the bobbin 9 can be removably attached. When the bobbin 9 is fixed to the chuck 11, and the bobbin 9 and the chuck 11 are rotated in unision.

The bobbin 9 has an essentially cylindrical shape. A base plate 92 has V-grooves 91 for holding the wire ends and is fixed to one end of the bobbin. An outer circumference of the base plate is formed with grooves 93 for winding the wire 8. In the preferred embodiment, the wire 8 is wound on the bobbin 9 along paths (see FIG. 6) denoted by reference symbols a to m, wherein two coils 8A and 8B are formed concurrently. That is, the wire is initially wound from the position denoted by the reference symbol a through the V-groove 91 and wound five times along the path of one coil 8A passing through the reference symbols b-c-d-e-f, respectively. Thereafter, the wire is wound five times along the path of one coil 8B ranging from the reference symbol c to g-h-i-j-g. Following this, the wire is wound from the reference symbol j through k-l-V groove 91 to a reference symbol m.

Figure 3:
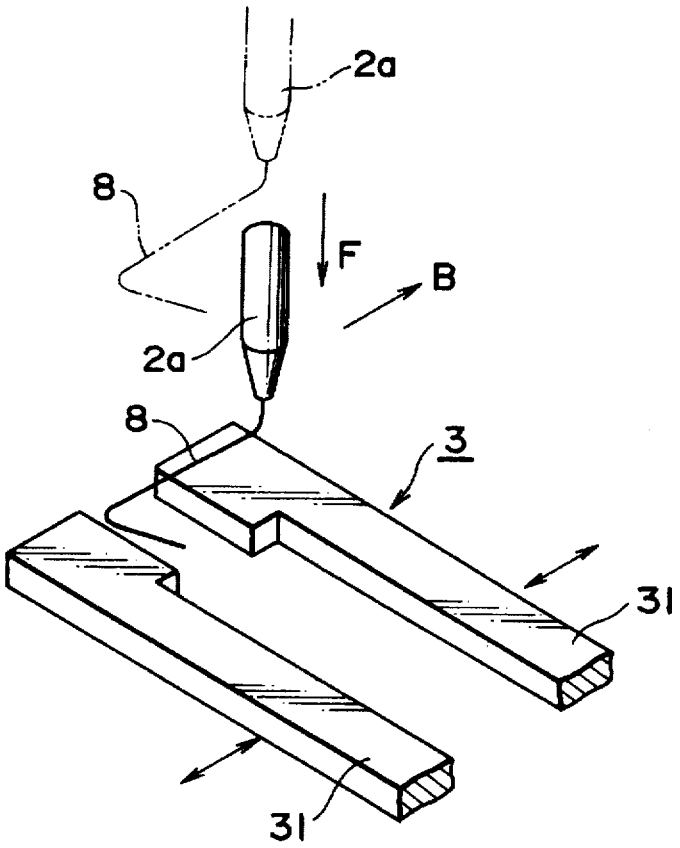
FIG. 3 is a schematic perspective view showing a configuration of a wire clamp used in accordance with the present invention.
Figure 4:
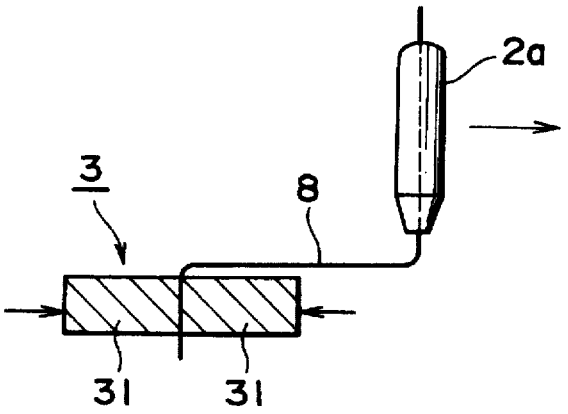
FIG. 4 is a cross-sectional view showing a the wire clamp of the present invention.

FIGS. 3 and 4 show a part of the wire clamp 3 which includes a pair of holding members 31 and 31 which are movable between positions wherein they abut each other and wherein they are spaced apart from each other, under the control of an actuator not shown. One end of the wire 8 is clamped between the ends of the pair of holding members 31, so that it can be rotated synchronously with the chuck 11 of the bobbin rotating unit 1.

Figure 5:
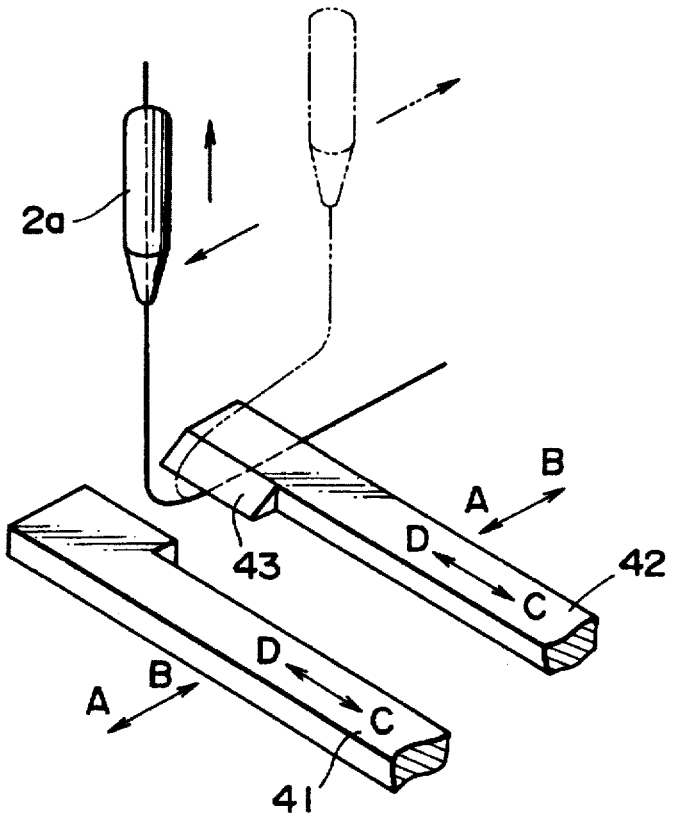
FIG. 5 is a schematic perspective view showing a clamp cutting part used in accordance with the present invention.

FIG. 5 shows part of the clamp having a cutting part or blade 43, the clamp and cutting part respectively are connected to a pair of holding members 41 and 42 which are movable between positions wherein they abut each other and wherein they are spaced apart from each other, under the control of an actuator (not shown). In addition, the pair of holding members 41 and 42 are constructed such that they can be synchronously moved in the same direction (an arrow C-D direction as viewed in FIG. 5), concurrently their positions with respect to the chuck 11 can be optionally changed over and the end of the holding member 41 can be formed with the cutting blade 43.

The wire nozzle moving mechanism 5 has a Y-axis direction moving part **5*a* for moving the nozzle 2*a* in a vertical direction (E-F direction as viewed in FIG. 2) and an X-axis direction moving part 5*b* for moving the nozzle 2*a* in a horizontal forward-rearward direction (A-B direction as viewed in FIG. 2) in parallel with an axis of the bobbin 9**.

Data corresponding to a coil shape wound on the bobbin 9 to set in the NC (numerical control) control part 6. The NC (numerical control) control part controls a wire feeding amount of the wire fed out of the wire nozzle 2 in response to the data, rotation of the bobbin rotating unit part 1, the wire clamping at the wire clamping part 3, wire cutting at the clamp and cutting part 4, and an operation of the wire nozzle moving mechanism 5. FIG. 1 is a flow chart showing a procedure in which the coil winding device is controlled by the NC (numerical control) control part 6. In this case, referring to the flow chart shown in FIG. 1, an entire operation of the coil winding device will be described.

Figure 6:
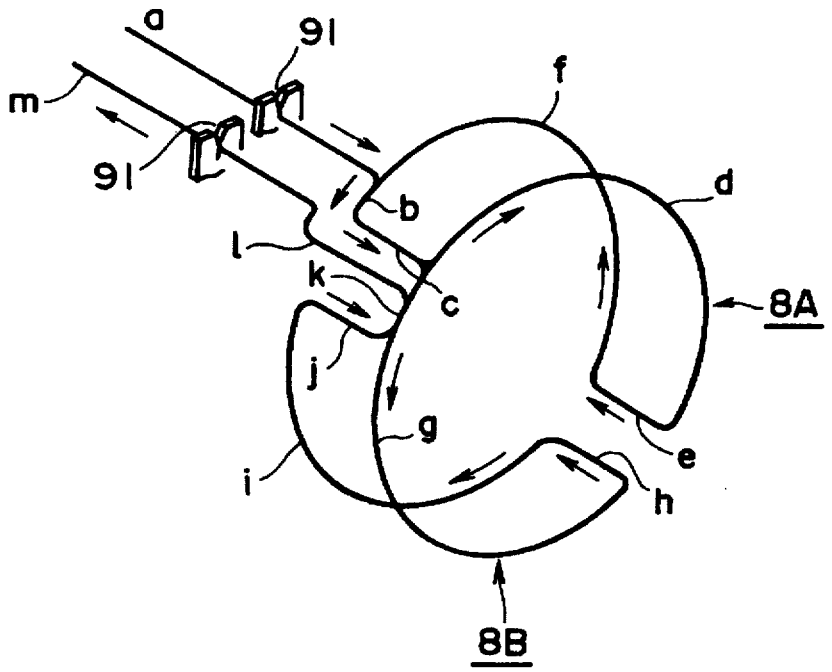
FIG. 6 is a schematic view showing a wire winding path for a bobbin in accordance with the present invention.

First, a vacant bobbin 9 is set at the bobbin rotating unit part 1, the nozzle **2*a* is lowered by the wire nozzle part moving mechanism 5 (an arrow F direction as viewed in FIG. 3) and then the wire clamp part 3 clamps the extremity end of the wire 8 fed out of the extremity end of the nozzle 2*a* to cause the part denoted by the reference symbol a in FIG. 6, to be led and moved toward the bobbin 9 (in the direction B shown in FIGS. 3 and 4). In addition, when the wire is led onto the bobbin 9, the midway part of the wire 8 is held in the V-groove 91**.

Then, under a cooperative relation between a forward or rearward motion of the nozzle **2*a* with the wire-nozzle part moving mechanism 5 and a rotating operation of the bobbin 9 with the bobbin rotating unit part 1, the coil shown in FIG. 6 is wound on the bobbin 9 and held in the V-groove 91 at the winding finished end, thereafter the wire is taken out as a lead end shown by the reference symbol m. In addition, as the nozzle 2*a* is moved up to the position at the clamp and cutting part 4, the clamp and cutting part 4 is moved in an arrow D direction as viewed in FIG. 5 and the wire 8 is held between the pair of holding members 41 and 42. Then, the nozzle 2*a* is lifted up in a direction indicated by an arrow E in FIG. 5, thereafter moved in a direction indicated by the arrow B as viewed in FIG. 5. Then, at this time, the wire 8 fed out of the nozzle 2*a* is cut, thereby a VLF coil having the desired windings applied on the bobbin 9 is completed. Then, the same operation as above is repeated again and similar VLF coils are made in sequence. In the case that the length of the winding finished end is to be changed, the position of the clamp and cutting part 4 in respect to the chuck 11** is changed, thereby the length can be optionally adjusted.

Accordingly, in the case that the coil winding device of the preferred embodiment is applied, the wire 8 can be automatically wound at the bobbin 9 to form a desired coil, so that it is possible to perform an efficient and easy manufacturing of coil having a stable quality.

Further, since the clamp and cutting part 4 (cutting means) can adjust optionally a length of the winding finished end of the wire 8 fed out of the bobbin 9, the coil having the proper length wire end with no useless volume can always be obtained.

In addition, the outer circumference of the bobbin 9 is provided with grooves for use in guiding the wire 8 to wind up the wire in the grooves, so that the position setting of the coil on the bobbin 9 can be performed easily and accurately and further a stable quality can be attained.

In addition, the two coils 8A and 8B can be made concurrently, so that the related art soldering device in assembling the VLF coil can be eliminated.

In addition, although the preferred embodiment has been described in reference to the case in which the VLF coil is manufactured, it is of course apparent that the present invention can be applied similarly to coils other than those disclosed in connection with the preferred embodiment.

As described above, according to the present invention, it is possible to easily form the desired coil by winding the wire automatically on the bobbin and to perform an efficient production of the coil having a stable quality.

In addition, in the case that the cutting means can optionally adjust the length of the end of the wire fed out of the bobbin, the coil always having a proper length with no surplus wire can be attained.

Further, in the case that the outer circumference of the bobbin is provided with grooves for use in guiding the wire and the wire is wound in the grooves the position setting of the coil on the bobbin can be easily and accurately performed.

What is claimed is:

1. A coil winding device comprising:

a bobbin rotating unit for holding and rotating a bobbin upon which a wire is to be wound;

a nozzle for feeding wire onto said bobbin;

wire clamp means for clamping a first portion of the wire fed out of said nozzle, said wire clamp means being rotated synchronously with said bobbin rotating unit;

cutting means for clamping and cutting a second portion of the wire which has been fed out of said nozzle and wound onto said bobbin; and control means for controlling of selective motion of said nozzle in a vertical direction substantially at a right angle to a horizontal direction in parallel with an axis of said bobbin, controlling a rotation of said bobbin rotating unit, controlling a clamp of said wire with said wire clamp means and controlling the clamp and cutting of said wire with said cutting means.

2. A coil winding device as set forth in claim 1, in which said cutting means can adjust optionally a length of an end portion of the wire which is fed out of said nozzle and wound on said bobbin.

3. A coil winding device as set forth in claim 1, in which an outer circumference of said bobbin is provided with grooves for use in guiding said wire and said wire is wound in said grooves.

4. A coil winding method comprising the steps of:

continuously controlling a rotation of a bobbin rotating unit which rotates a bobbin onto which a wire is wound, using a control means, feeding wire out through a nozzle, clamping a first portion of wire fed out of the nozzle using clamping and means and rotating the clamping means with the bobbin rotating unit, and clamping and cutting a second portion of the wire after the wire has been wound on said bobbin using clamping and cutting means.

5. A coil winding method as set forth in claim 4, wherein an outer circumference of said bobbin is provided with guide grooves into which the wire is wound.

6. A coil winding method comprising the steps of:

rotating a bobbin in a predetermined manner;

feeding wire out through a nozzle;

clamping a first portion of the wire from the nozzle using a clamp which rotates synchronously with the bobbin;

moving the nozzle in at least two mutually opposed linear directions so as to, in combination with the rotational movement of the bobbin, wind a coil having a predetermined configuration on the bobbin; and clamping and cutting a second portion of the wire after the wire has been wound on said bobbin, using stationary cutting and clamping means.

7. A coil winding apparatus comprising:

means for rotating a bobbin in a predetermined manner;

means for feeding wire out through a nozzle;

means for clamping a first portion of the wire from the nozzle using a clamp which rotates synchronously with the bobbin;

means for moving the nozzle in at least two mutually opposed linear directions so as to, in combination with the rotational movement of the bobbin, wind a coil having a predetermined configuration on the bobbin; and means for clamping and cutting a second portion of the wire after the wire has been wound on said bobbin, said clamping and cutting means being stationary with respect to the rotating bobbin.

* * * * *